US007474866B2

(12) United States Patent
Doi et al.

(10) Patent No.: US 7,474,866 B2
(45) Date of Patent: Jan. 6, 2009

(54) SEALING MEMBER, TONER SUPPLY CONTAINER, AND TONER SUPPLY SYSTEM

(75) Inventors: Shigeo Doi, Toride (JP); Masashige Tamura, Toride (JP); Daisuke Kawaguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 11/269,754

(22) Filed: Nov. 9, 2005

(65) Prior Publication Data

US 2006/0104660 A1 May 18, 2006

(30) Foreign Application Priority Data

Nov. 12, 2004 (JP) ..... 2004-329611

(51) Int. Cl.
*G03G 15/08* (2006.01)

(52) U.S. Cl. ..... 399/120; 399/102; 399/105; 399/112; 399/113

(58) Field of Classification Search ..... 399/102, 399/105, 112, 113, 120
See application file for complete search history.

(56) References Cited

U.S. PATENT DOCUMENTS

| | | | | |
|---|---|---|---|---|
| 5,828,935 | A | 10/1998 | Tatsumi et al. | 399/260 |
| 6,879,789 | B2 | 4/2005 | Yamada et al. | 399/106 |
| 6,920,298 | B2 | 7/2005 | Yamada et al. | 399/106 |
| 6,944,417 | B2 | 9/2005 | Yamada et al. | 399/263 |
| 6,990,301 | B2 | 1/2006 | Yamada et al. | 399/106 |
| 6,993,273 | B2 * | 1/2006 | Yamada | 399/258 |
| 2004/0131389 | A1 * | 7/2004 | Tazawa et al. | 399/258 |
| 2005/0047818 | A1 | 3/2005 | Yamada et al. | 399/106 |
| 2006/0008290 | A1 | 1/2006 | Yamada et al. | 399/106 |
| 2006/0008291 | A1 | 1/2006 | Yamada et al. | 399/106 |
| 2006/0034641 | A1 | 2/2006 | Yamada et al. | 399/258 |

FOREIGN PATENT DOCUMENTS

| | | |
|---|---|---|
| JP | 5-75768 | 10/1993 |
| JP | 10-63076 | 3/1998 |
| JP | 10-63084 | 3/1998 |
| JP | 2002-318490 | 10/2002 |
| JP | 2003-76123 | 3/2003 |

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

A coupling member of a toner supply container in a toner supply system detachably mountable to an image forming apparatus, includes a rotatable engagement portion provided with a hook portion which is hook-engageable with an engagement member provided in the image forming apparatus to receive a rotational force for discharging the developer in the container; a release portion for receiving a force, for displacing the hook portion inwardly in a radial direction, from a hollow release member provided in the image forming apparatus so as to release engagement of the hook portion with the engagement member; and a regulation portion provided with a hollow cylindrical portion in which a regulation shaft provided in the image forming apparatus is insertable to regulate an inclination of the coupling member by contact with the regulation shaft when the coupling member is moved away relative to the engagement member in an axial direction of the engagement portion in a state in which the release portion receives the force from the hollow release member.

8 Claims, 8 Drawing Sheets

SEALING MEMBER, TONER SUPPLY CONTAINER, AND TONER SUPPLY SYSTEM

FIELD OF THE INVENTION AND RELATED ART

The present invention relates to a toner supply container detachably mountable to an image forming apparatus such as a copying machine, a printer, a facsimile apparatus, or the like, and relates to a sealing member for sealing a toner discharge opening of the toner supply container and a toner supply system.

In a conventional electrophotographic image forming apparatus such as an electrophotographic copying machine or a printer, fine powdery toner has been used as a developer. In the case where toner contained in a main assembly of the image forming apparatus is consumed, toner is supplied has been supplied into the image forming apparatus main assembly.

Incidentally, toner is fine powder generally having a particle size of approximately 3-10 μm, so that a toner supply container is mounted inside the image forming apparatus main assembly and toner is discharged from a small opening little by little so as not to cause toner scattering during toner supply operation.

The toner supply container receives some driving force from the image forming apparatus main assembly or a toner supply apparatus to drive a toner feeding member of the toner supply container or the toner supply container itself, thus permitting discharge of the toner from the toner supply container. Here, there are some means (constitutions) as a driving force transmission means for transmitting a driving force to the toner supply container. For example, as described in Japanese Laid-Open Utility Model Application No. Hei 5-075768 (JP5075768U), there has been known such a constitution that a cylindrical toner supply container is provided with a gear portion at an outer peripheral surface thereof and a driving force is transmitted to the gear portion to rotate the toner supply container itself.

Further, as described in Japanese Laid-Open Patent Application (JP-A) No. Hei 10-063084, there is also known such a constitution that a cylindrical toner supply container is provided with a projection for rotational movement at an end surface thereof and the projection is engaged with a recess portion provided to an image forming apparatus main assembly or a drive portion of a toner supply apparatus to transmit a driving force.

As another example, JP-A Hei 10-063076 discloses such a constitution that an inner surface of a rotational force transmitting portion of an image forming apparatus main assembly is provided with a plurality of engage grooves and a toner supply container is provided with a plurality of projections which are engaged with the grooves, respectively, to transmit a driving force.

Further, JP-A 2003-076123 discloses such a constitution that a toner supply container is moved in a rotational axis direction during mounting and demounting of a toner supply container.

However, the above described conventional driving force transmitting constitutions have been accompanied with the following problems.

In the constitution described in JP5075768U, it was necessary to not only provide a means for ensuring engagement of the gear portion provided to the toner supply container but also perform the engagement of the gear portion during setting of the developer supply container. Alternatively, it was necessary to provide such a constitution that the engagement of the gear portion is always performed well. Similarly, also in the constitution described in JP-A Nos. Hei 10-063084 and Hei 10-063076, it was necessary to effect positional alignment at the engagement portion, so that the constitutions are disadvantageous in terms of usability.

In order to solve these problems, JP-A No. 2002-318490 has proposed such a constitution that a sealing member of a toner container is opened and closed by engaging a sealing portion of a toner supply container and a driving force transmitting portion of an image forming apparatus main assembly or a toner supply apparatus in a snap-fit manner.

However, in the constitution described in JP-A No. 2002-3148490, particularly during removal of the toner supply container from the image forming apparatus main assembly or the toner supply apparatus, a projection portion provided for releasing the snap-fit engagement cannot be uniformly pushed while keeping a balance. As a result, it is difficult to sufficiently ensure an amount of retraction of all the plurality of engaging projections, so that the snap-fit cannot be released completely in some cases.

Further in the case of the constitution described in JP-A No. 2003-076123 in which the toner supply container is moved in the rotational axis direction during mounting and demounting of the toner supply container, it is necessary to ensure a high accuracy in alignment of the sealing portion of the toner supply container with the driving force transmitting portion on the rotational axis similarly as in the above described case. In addition, the same problem as described above arises in the case where the movement direction of the toner supply container is not completely in alignment with the rotational axis direction of the driving force transmitting portion.

Further, in the constitutions described in JP-A Nos. 2003-076123 and 2002-318490, in the case where backlash is provided at the snap-fit engagement portion in order to absorb a deviation of a degree of alignment between the driving force transmitting portion and the rotational axis of the toner supply container, particularly, it is not easy to uniformly push the projection portion provided for snap-fit engagement while keeping a balance.

SUMMARY OF THE INVENTION

An object of the present invention is to provide a sealing member capable of effecting release of engagement thereof with an engagement member.

Another object of the present invention is to provide a toner supply container using the sealing member and a toner supply system using the sealing member.

According to an aspect of the present invention, there is provided a coupling member of a toner supply container detachably mountable to an image forming apparatus, comprising:

an engagement portion provided with a hook portion which is hook-engageable with an engagement member provided in the image forming apparatus;

a release portion for receiving a force, for moving the hook portion inward in a radial direction, from a hollow release member provided in the image forming apparatus so as to release engagement of the hook portion with the engagement member; and a regulation portion for regulating an inclination of the coupling member by contact thereof with a regulation member provided in the image forming apparatus when the coupling member is moved relative to the image forming apparatus in a state in which the release portion receives the force from the hollow release member.

According to another aspect of the present invention, there is provided a toner supply container detachably mountable to an image forming apparatus, comprising:

a container for containing toner; and a coupling member engageable with an engagement member provided in the image forming apparatus;

wherein the coupling member comprises:

a hook portion which is hook-engageable with the engagement member provided in the image forming apparatus;

a release portion for receiving a force, for moving the hook portion inward in a radial direction, from a hollow release member provided in the image forming apparatus so as to release engagement of the hook portion with the engagement member; and a regulation portion for regulating an inclination of the coupling member by contact thereof with a regulation member provided in the image forming apparatus when the coupling member is moved relative to the image forming apparatus in a state in which the release portion receives the force from the hollow release member.

According to a further aspect of the present invention, there is provided a toner supply system, comprising:

a toner supply apparatus comprising an engagement member, a regulation member, and a hollow release member; and a toner supply container detachably mountable to the toner supply apparatus, the toner supply container comprising a container for containing toner and a coupling member;

wherein the coupling member comprises:

a hook portion which is hook-engageable with the engagement member;

a release portion for receiving a force, for moving the hook portion inward in a radial direction, from the hollow release member so as to release engagement of the hook portion with the engagement member; and a regulation portion for regulating an inclination of the coupling member by contact thereof with a regulation member when the coupling member is moved relative to the engagement member in a state in which the release portion receives the force from the hollow release member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

Figure 1:
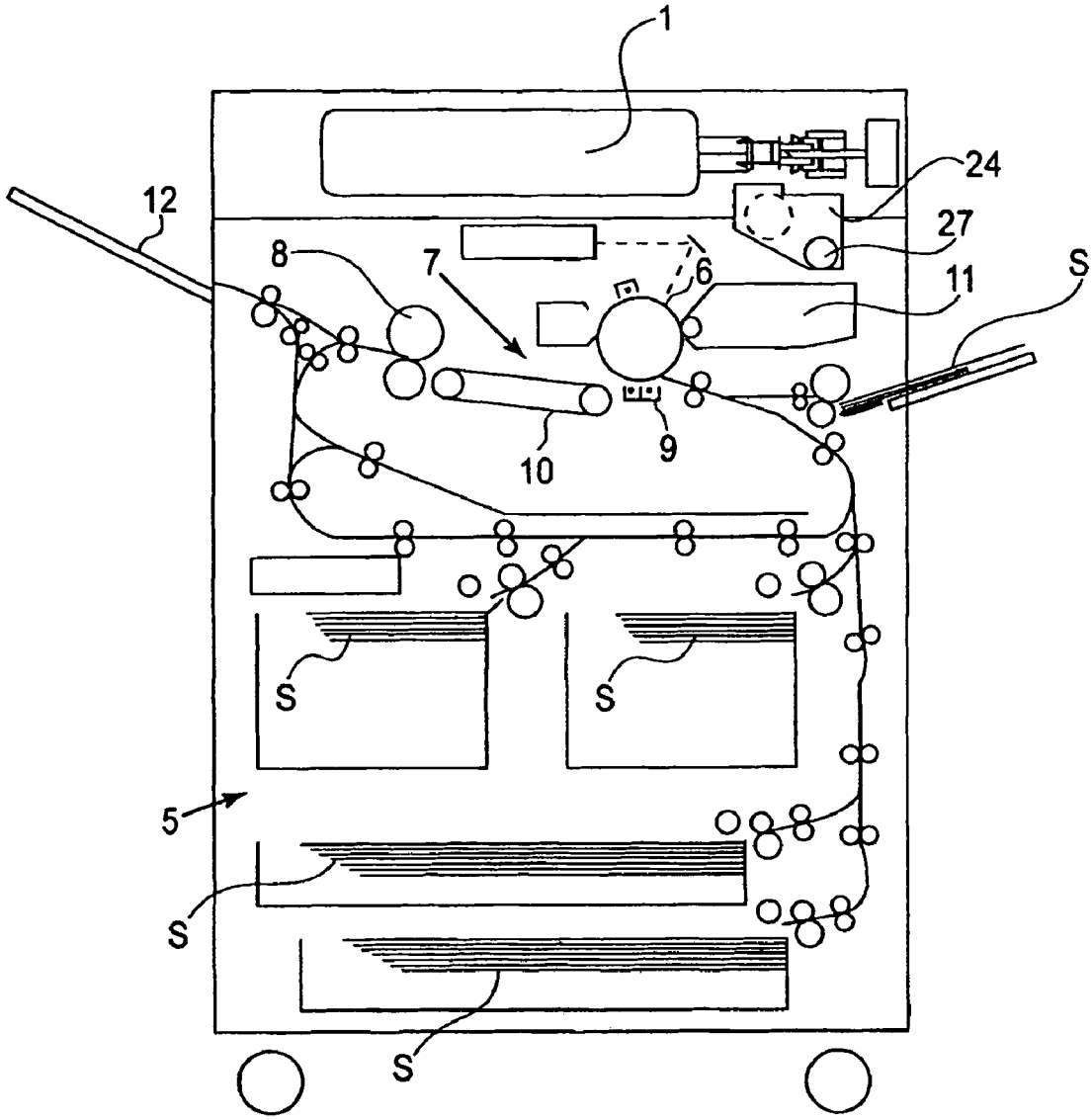
FIG. 1 is a schematic sectional view of an image forming apparatus provided with a toner container (toner supply container) according to the present invention.

FIG. 1 is a cross-sectional view of an image forming apparatus including a toner container as a toner supply container according to the present invention.

In the image forming apparatus of this embodiment, a toner container 1 as the toner supply container is horizontally mounted in a main assembly of the image forming apparatus. Toner to be discharged from the toner container 1 is once contained in a hopper 24 as an accommodation means and then fed to a developing device 11. The toner fed to the developing device 11 is subjected to development of an electrostatic latent image formed on a photosensitive drum 6 as an image bearing member at an image forming portion 7, so that a toner image is formed on the photosensitive drum 6.

Onto a transfer material S conveyed from a sheet (paper) supply means 5, the toner image formed at the image forming portion 7 is transferred by the action of a transfer charger 9. The transfer material S is conveyed to a fixing device 8 by a conveyance means 10, where the toner image on the transfer material S is fixed under heat and pressure and then the transfer material S is discharged into a discharge (output) tray 12.

Figure 2:
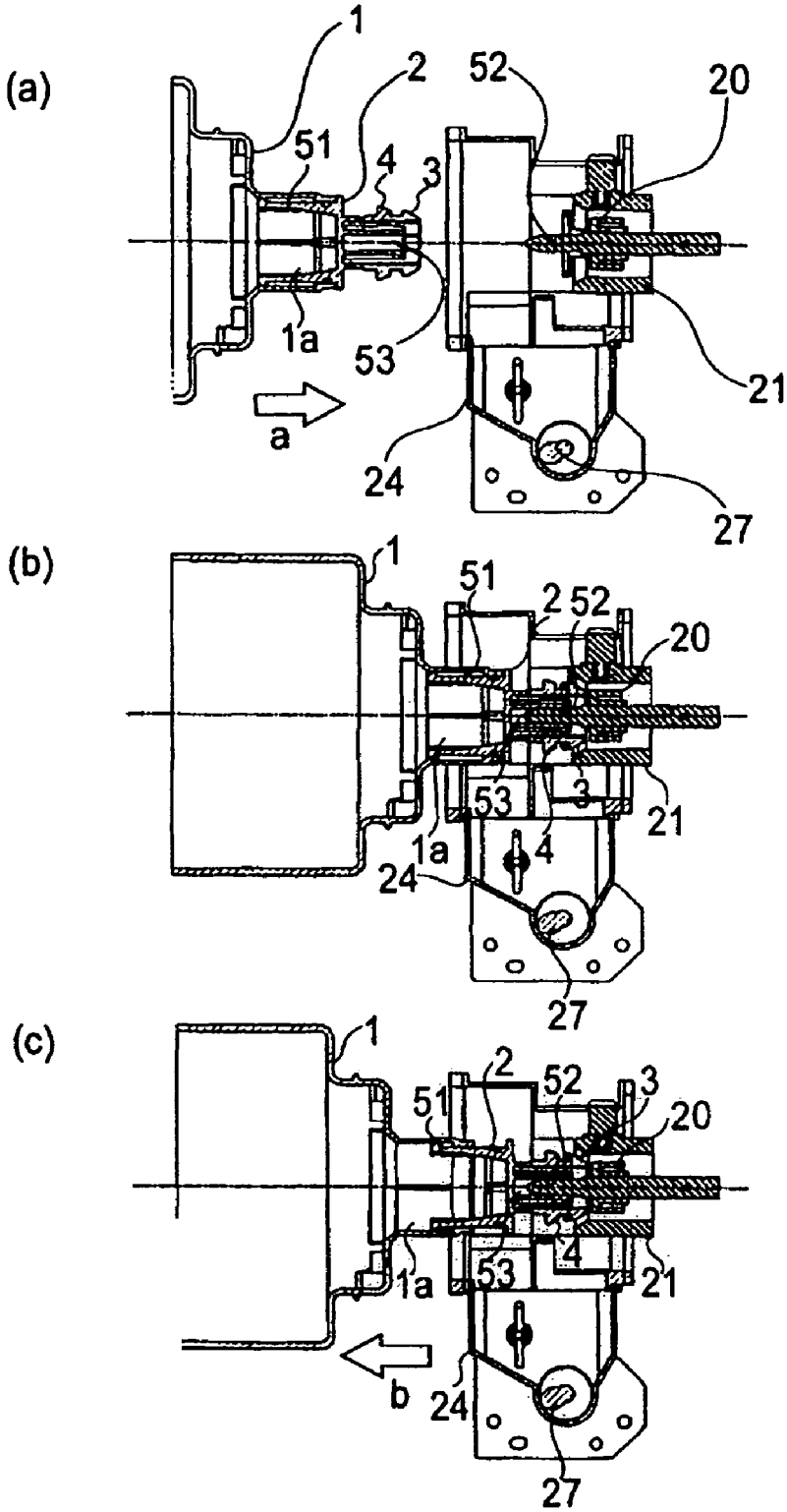
FIGS. 2(A), 2(B) and 2(C) are partial side-sectional views for illustrating a schematic constitution and action of a toner supply apparatus.

FIGS. 2(A), 2(B) and 2(C) are partial side-sectional views for illustrating a schematic constitution and action of a toner supply apparatus to be mounted to a main assembly of the image forming apparatus.

The toner supply apparatus is provided with a drive portion (driving force transmitting portion) 20 for rotationally driving the toner container 1 by being connected with the toner container 1. The drive portion 20 is rotationally driven by an unshown drive motor incorporated in the toner supply apparatus. Further, in the toner supply apparatus, a screw member 27 for feeding toner to be supplied contained in the hopper 24 (FIG. 1) to the developing device 11 (FIG. 1).

FIG. 2(A) shows a starting state of mounting of the toner container 1 into the apparatus main assembly. In this state, the toner container 1 is not fixed to the apparatus main assembly, so that a user is capable of mounting the toner container 1 to or demounting the toner container 1 from the apparatus main assembly. At one end surface of the toner container 1, a toner discharge opening 1*a* is provided. The toner discharge opening 1*a* is sealed up by a sealing member 2 at an end portion thereof.

FIG. 2(B) shows a state in which the mounting of the toner container 1 is further performed by an operation of an unshown container holding member in a direction of an arrow a indicated in FIG. 2(A) and an engagement projection 3 is engaged in an engagement hole of the driving portion 20. In this state, by a sliding operation for causing the sealing member and the drive portion 20 of the apparatus main assembly to come close to each other, first of all, the engagement projection 3 of the sealing member 2 is engaged with the engagement hole of the drive portion 20 in a snap-fit manner simultaneously with engagement of an aligning and mating portion 52 provided at a center of the drive portion 20 with an engaging portion 53 provided at a center of the sealing member 20. Such a state is shown in FIG. 3.

Figure 3:
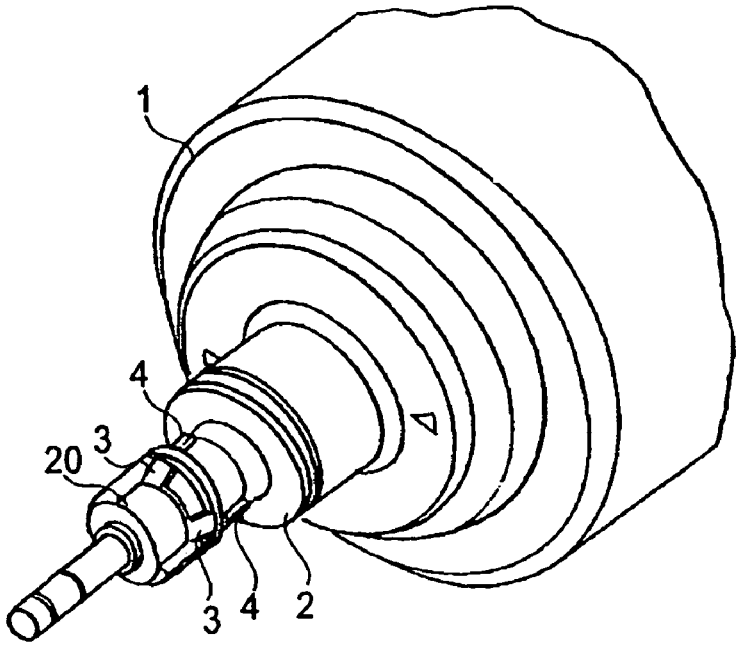
FIG. 3 is a partial perspective view showing an engagement state of a driving force transmitting portion and a sealing member.

Referring to FIG. 3, a taper portion is provided at an end portion of the mating portion 52. The mating portion 52 is inserted into the engaging portion 53 of the sealing member 2 but is not completely engaged therewith immediately before the engagement projection 3 of the sealing member 2 and the engagement hole of the drive portion 20 are engaged with each other in a snap-fit manner. When the engagement projection 3 of the sealing member 2 is engaged with the engagement hole of the drive portion 20 in the snap-fit manner, the rotation axis of the drive portion and that of the toner container 1 are substantially in alignment with each other.

FIG. 2(C) shows a state in which the container holding member is moved backward in a direction of an arrow b after the sealing member 2 and the drive portion 20 are engaged with each other. When the container holding member is moved backward, the toner container 1 is also moved backward but the sealing member 2 is fixed by the engagement at the image forming apparatus main assembly (the drive portion 20), so that the sealing member is relatively separated from the toner container 1 to open the toner discharge opening 1*a*, thus permitting supply of the toner. In other words, an opening operation of the sealing member 2 is automatically performed by moving backward the container holding member. As described later, a closing operation of the sealing member 2 is also performed automatically.

In the above state, when an unshown drive motor is driven, a rotational driving force is transmitted from the drive portion 20 to a driving force receiving surface as a driving force receiving portion of the engagement projection 3 and then transmitted from the sealing member 2 to the toner container 1 to rotate the toner container 1. As a result, the supply toner contained in the toner container 1 is fed and discharged out of the toner container 1.

Details of the constitution of the toner container 1, the sealing member 2, and the drive portion will be described with reference to FIGS. 4-6.

Figure 4:
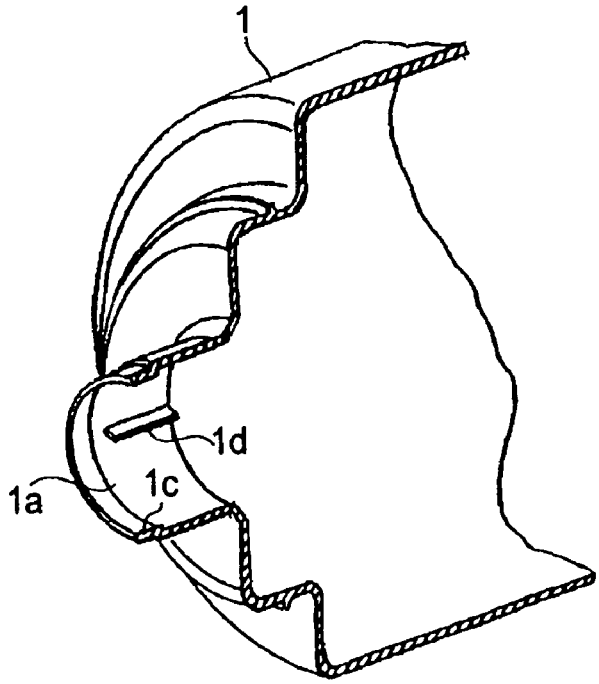
FIG. 4 is a partial perspective view of the toner container in a state in which the toner container is cut into half.
Figure 5:
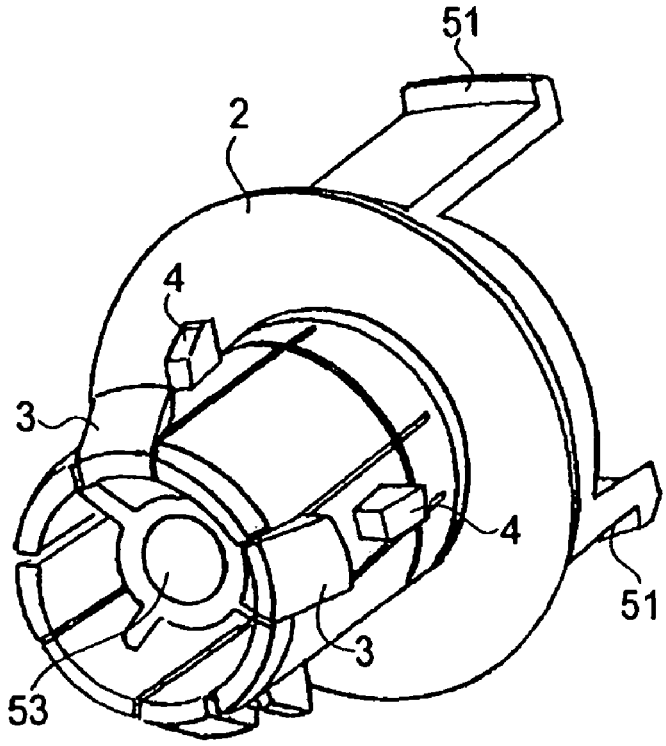
FIG. 5 is a perspective view of the sealing member.
Figure 6:
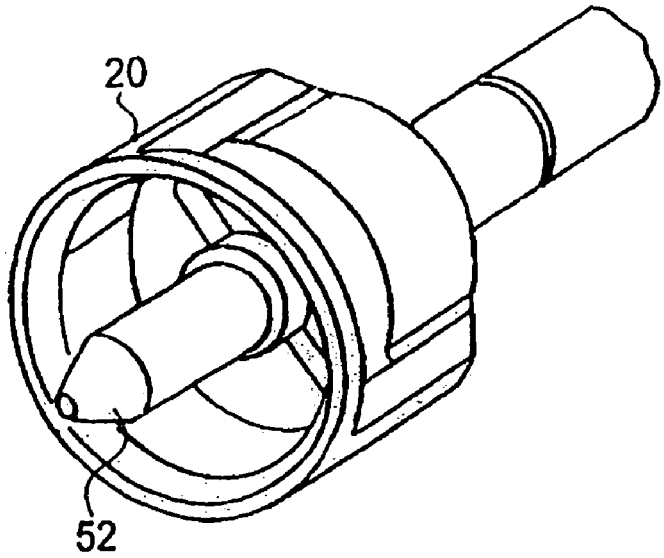
FIG. 6 is a perspective view of the driving force transmitting portion.

As shown in FIG. 5, a plurality of claw members 51 (two members in this embodiment) are provided to the sealing member 2 and are inserted into the opening 1*a* of the toner container 1 as shown in FIGS. 2(A) to 2(C). Further, as shown in FIG. 4, a claw stop portion 1*c* is disposed at an inner peripheral portion of the opening 1*a* of the toner container 1 so as not to completely separate the sealing member 1 from the toner container 1.

Further, as shown in FIG. 4, at the inner peripheral portion of the opening 1*a*, a plurality of rib portion 1*d* (two ribs in this embodiment but only one rib is shown in FIG. 4) are disposed in a direction perpendicular to the rotation direction of the toner container 1. Accordingly, when the driving force is transmitted to the sealing member 2 by the drive portion 20, the sealing member 2 is rotated to cause the claw members 51 of the sealing member 2 to abut against the rib portions 1*d*, thus causing the toner container 1 itself to rotate on its axis. In other words, the sealing member 2 has the functions of not only sealing the opening 1*a* and receiving the rotational driving force but also transmitting the rotational driving force to the toner container 1. As described above, by the rotation of the toner container 1 through the sealing member 2, the toner contained in the toner container 1 is successively discharged from the opening 1*a* and conveyed to the developing device 11 (FIG. 1) by the screw member 27 (FIG. 2) provided in the hopper 24, thus being supplied into the developing device 11.

Incidentally, in this embodiment, the number of the claw members 51 provided to the sealing member 2 is two. This is principally because the claw member 51 come in contact with the inner peripheral surface of the opening 1*a* of the toner container 1 at two points, so that the sealing member 2 and the toner container 1 function as a simple joint to permit smooth transmission of the driving force from the sealing member 2 to the toner container 1 even when there is some degree of deviation from alignment of the rotational axis of the sealing member 2 with that of the toner container 1.

Figure 7:
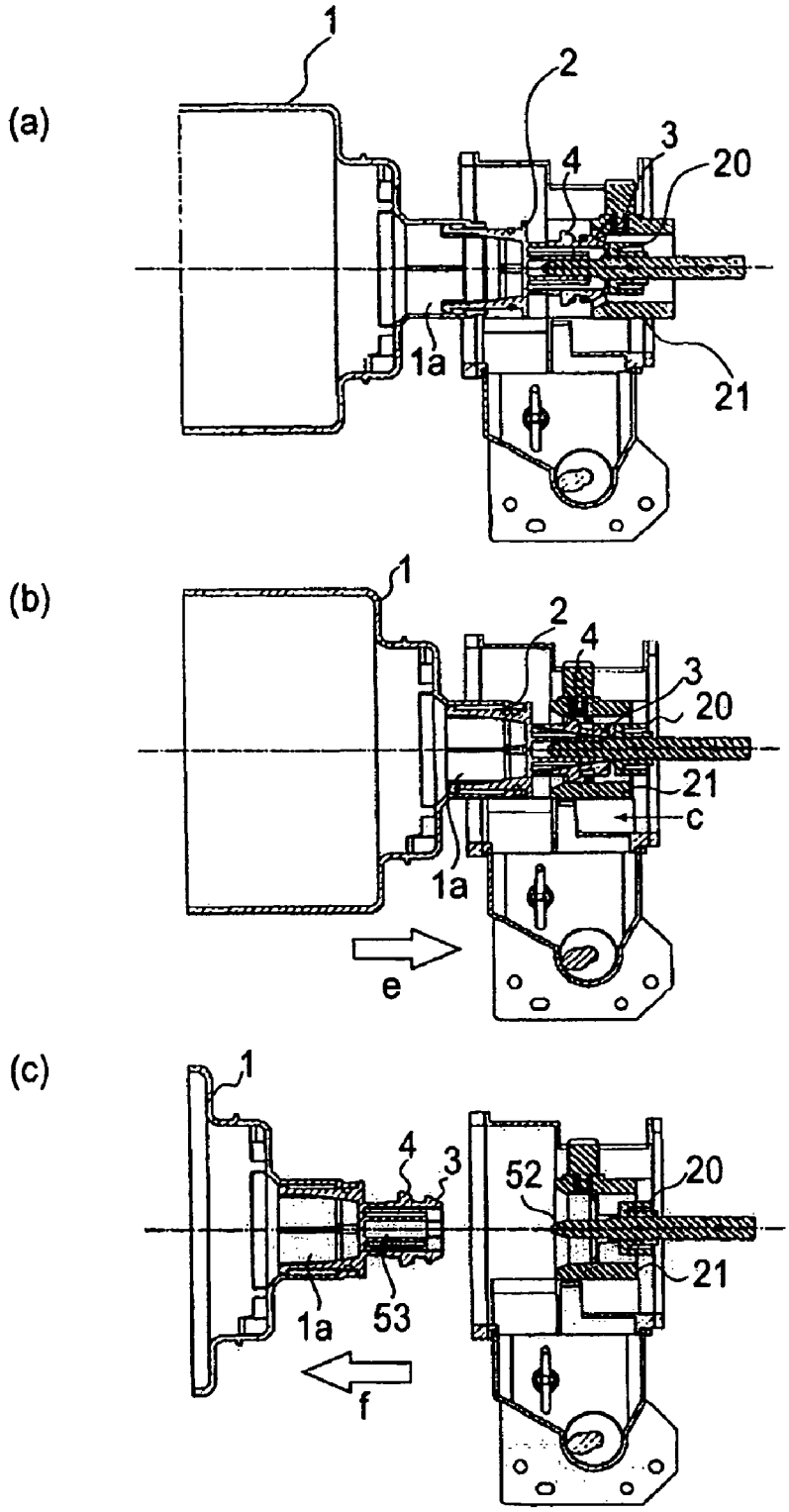
FIGS. 7(A), 7(B) and 7(C) are partial sectional views for illustrating a removal operation of the toner container from the driving force transmitting portion.

FIGS. 7(A) to 7(C) show details of the drive portion 20. FIG. 7(A) shows the same state as that shown in FIG. 2(C). In this state, the engagement projection 3 provided at the end portion of the sealing member 2 is engaged in the engagement hole of the drive portion 20 of the apparatus main assembly and the opening 1*a* is opened by the operation of the toner container 1, so that the toner can be supplied from the toner container 1.

In order to release the engagement between the drive portion and the sealing member 2, as shown in FIG. 7(B), an open/close control member 21 provided to the drive portion 20 is moved in a direction of an arrow c direction to cause a release projection 4 provided at an end portion of the sealing member 2 to enter the open/close control member 21. As a result, the release projection 4 is pressed by the inner peripheral surface of the open/close control member 21 to be moved inward and at the same time, the engagement projection 3 is also moved inward together with the release projection 4. As a result, the engagement of the engagement projection 3 with the drive portion 20 is released.

On the other hand, when the toner container 1 is moved in a direction of an arrow e shown in FIG. 7(B), the opening 1*a* of the toner container 1 is sealed by the sealing member 2. Incidentally, as shown in FIG. 2(A), when the sealing member 2 and the drive portion 20 are engaged with each other, the open/close control member 21 means in a standby state at a position shown in FIG. 7(A).

Thereafter, as shown in FIG. 7(C), in such a state that the open/close control member 21 remain in a stationary state, by moving the toner container 1 in a direction of an arrow f, as described above, the engagement between the drive portion 20 and the sealing member 2 is released, so that the toner container 1 can be removed from the drive portion 20. In this case, however, the opening 1*a* of the toner container 1 is placed in a state in which it is sealed by the sealing member 2.

In this embodiment, the open/close control member 21 is stopped after the operation in the arrow c direction and the opening 1*a* is sealed by the sealing member 2 by the movement of the toner container 1 in the arrow e direction. However, it is also possible to adopt such a method that the open/close control member 21 is moved in the arrow c direction as it is and the sealing of the opening 1*a* is performed after the movement of the sealing member 2 under pressure by the open/close control member 21 and then the movement of the open/close control member 21 is further continued to move the toner container 1 away from the drive portion 20 in the arrow f direction.

In this embodiment, an engagement backlash between the mating portion 52 provided at the center of the drive portion 20 and the engaging portion 53 provided at the center of the sealing member 2 is an important factor. Here, in the engagement state of the mating portion 52 with the engaging portion 53, when there is no slight gap therebetween, the mating portion 52 cannot enter the engaging portion 53 smoothly. On the other hand, when the gap between the mating portion 52 and the engaging portion 53 is excessively large, it is difficult to ensure the alignment of the sealing member 2 with the drive portion 20. In this embodiment, a value of the engagement backlash when the mating portion 52 has an outer diameter of 6 mm may appropriately be about 0.3% to 3%, i.e., 20 μm to 200 μm.

As described above, in this embodiment, the drive portion 20 and the sealing member 2 are provided with the mating portion 52 and the engaging portion 53, respectively, so that such a constitution that an inclination of not less than a predetermined angle of the sealing member 2 (an inclination of the sealing member 2 in the rotational axis direction with respect to the (forward and backward) movement direction of the open/close control member 21) is regulated by the abutment of the mating portion 52 provided in the image forming apparatus against the engaging portion 53 when the sealing member 2 is moved relative to the image forming apparatus in such a state that the release projection 4 receives the force from the open/close control member 21, is adopted. As a result, during a resealing operation, an occurrence of such a problem that the sealing member 2 is left standing in the image forming apparatus without release of the engagement thereof with the drive portion 20 is prevented.

Incidentally, by the above described engagement backlash, this embodiment is constituted so that the inclination of the sealing member 2 in the rotational axis direction with respect to the movement direction of the open/close control member 21 during the re-sealing operation is within ±5 degrees. When the sealing member 2 is inclined at an angle exceeding ±5 degrees, the above described problem was caused to occur.

Further, in the case where it is possible to reduce a production error and an assembly error of the image forming apparatus and the toner container 1 on the precondition that the mating portion 52 can enter the engaging portion 53, it is desirable that the inclination of the sealing member 2 in the rotational axis direction with respect to the movement direction of the open/close control member 21 during the re-sealing operation is constituted so as to be within ±2 degrees by the above described engagement backlash.

Figure 10:
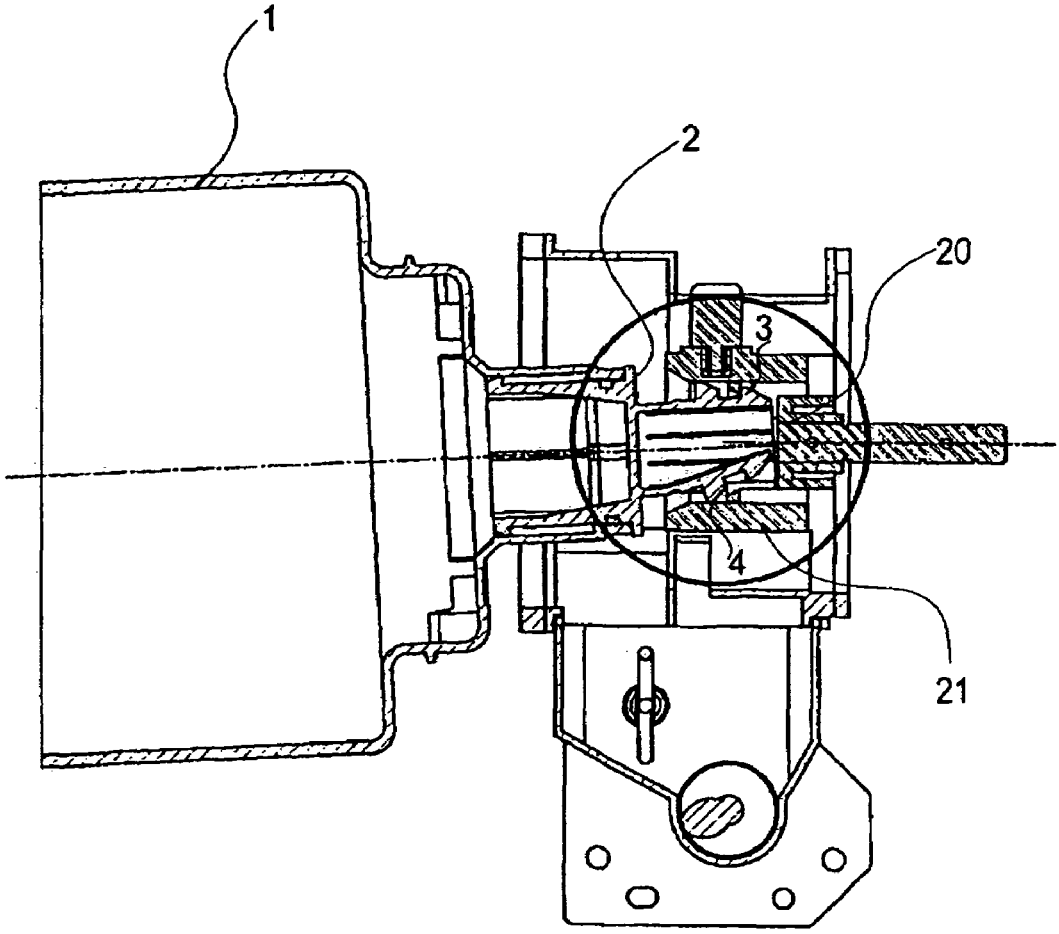
FIG. 10 is a schematic sectional view of a conventional toner supply apparatus.

In the case where both the mating portion 52 and the engagement portion 53 are not provided, as shown in FIG. 10, when the rotation axis of the toner container 1 is not in alignment with the rotation center axis of the drive portion 20, all the plurality of release projections 4 cannot be pressed uniformly by the open/close control member 21. As a result, any engagement with the engagement projections 3 cannot be released, so that there is a possibility that the toner container 1 cannot be mounted and demounted.

As described above, by reciprocating motions of the toner container 1 and the open/close control member 21 in the rotation axis direction (the directions of the arrows a and b shown in FIGS. 2(A) and 2(C)) and their combinations, the toner container 1 can be mounted in a toner suppliable state, released from a toner supply state, and moved away from the image forming apparatus to the mounting and demounting position of the toner container 1. More specifically, in view of ease of mounting and replacement of the toner container by a user, it is possible to consider the following cases including, e.g., a case where a part or all of the operations of the toner container 1 and the open/close control member 21 are performed in conjunction with the closing operation of a replacement door of the toner container, a case where a part or all of their operations are combined with an operation of an operating grip by the user, and a case where a part or all of their operations are performed automatically by adding a drive means such as a motor and moving the drive means by a signal from the apparatus main assembly.

Next, the toner container 1 and the open/close control member 21 will be specifically described. As an example, such an embodiment that reciprocating linear motions of the toner container 1 and the open/close control member 21 are performed with a user operation grip by a single operation by a user will be described.

The image forming apparatus according to the above described embodiment does not require a plurality of color toners, so that it is not necessary to particularly employ such a constitution that the toner container 1 is erroneously mounted. However, in the case where a plurality of color toners are used as in a color copying machine and the same toner container and the same toner supply apparatus are used for each of the color toners required or in the case where the same toner container and the same toner supply apparatus are used in a plurality of image forming apparatuses using different types of toners, it is necessary to employ discrimination means for preventing an operating error between the toner container and the toner supply apparatus or the image forming apparatus.

More specifically, an example of the discrimination means for discriminating the toner container between the mating portion provided to the drive portion and the engaging portion provided to the sealing member will be described.

Figure 8:
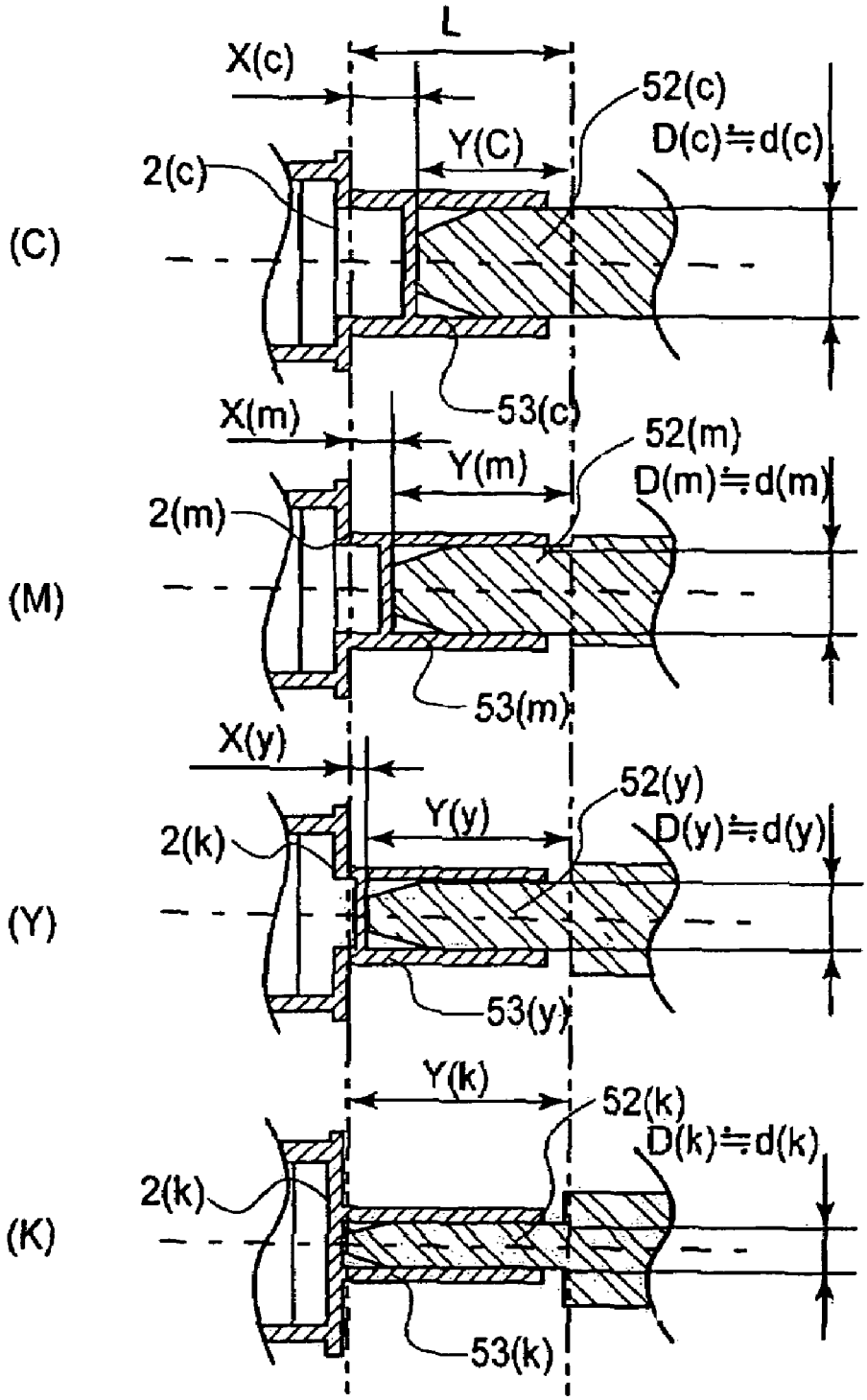
FIG. 8 includes partial sectional views for illustrating an example of proper engagement of the driving force transmitting portion with the sealing member.

FIG. 8 includes sectional views showing proper snap-fit engagement states of sealing members 2 (2(*c*), 2(*m*), 2(*y*), and 2(*k*)) for toner containers of four colors of cyan (C), magenta (M), yellow (Y) and black (K). For convenience of explanation, in FIG. 8, portions at which the engagement projection and the release projection of the sealing member 2 are provided are omitted, and with respect to the drive portion, only mating portions 52 (52(*c*), 52(*m*), 52(*y*), 52(*k*)) are depicted.

The mating portions 52 for the respective colors are characterized in that they have different outer diameters d (d(c), d(m), d(y) and d(k)) and different length Y (Y(c), Y(m), Y(y) and Y(k)) from a particular position to an end (point). Similarly, also with respect to the engaging portions 53 (53(*c*), 53(*m*), 53(*y*) and 53(*k*)) of the sealing members 2 (2(*c*), 2(*m*), 2(*y*) and 2(*k*)), they have different inner diameters D (D(c), D(m), D(y) and D(k)) and different distances X (X(c), X(m), X(y) and X(k)) from a particular position to the respective bottom positions of the engaging portions 53 (53(*c*), 53(*m*), 53(*y*) and 53(*k*)).

In the case shown in FIG. 8, the following relationships (1) to (5) are satisfied among D, d, X and Y.

$$D(c)>D(m)>D(y)>D(k) \tag{1}$$

$$d(c)>d(m)>d(y)>d(k) \tag{2}$$

$$D(c)=d(c),\ D(m)=d(m),\ D(y)=d(y),\ \text{and}\ D(k)=d(k) \tag{3}$$

$$X(c)>X(m)>X(y)>X(k)=0 \tag{4}$$

$$Y(c)>Y(m)>Y(y)>Y(k) \tag{5}$$

Further, with respect to the respective colors, in the case where all the sealing members 2 and the drive portions 20 are engaged properly with each other, lengths L from a particular position of the mating portions 52 to a particular position of the sealing members 2 are equal to each other.

In other words, the following relationship (6) is satisfied.

$$L = X(c) + Y(c) = X(m) + Y(m) = X(y) + Y(y) = (x(k) = 0 +)Y(k) \tag{6}$$

Figure 9:
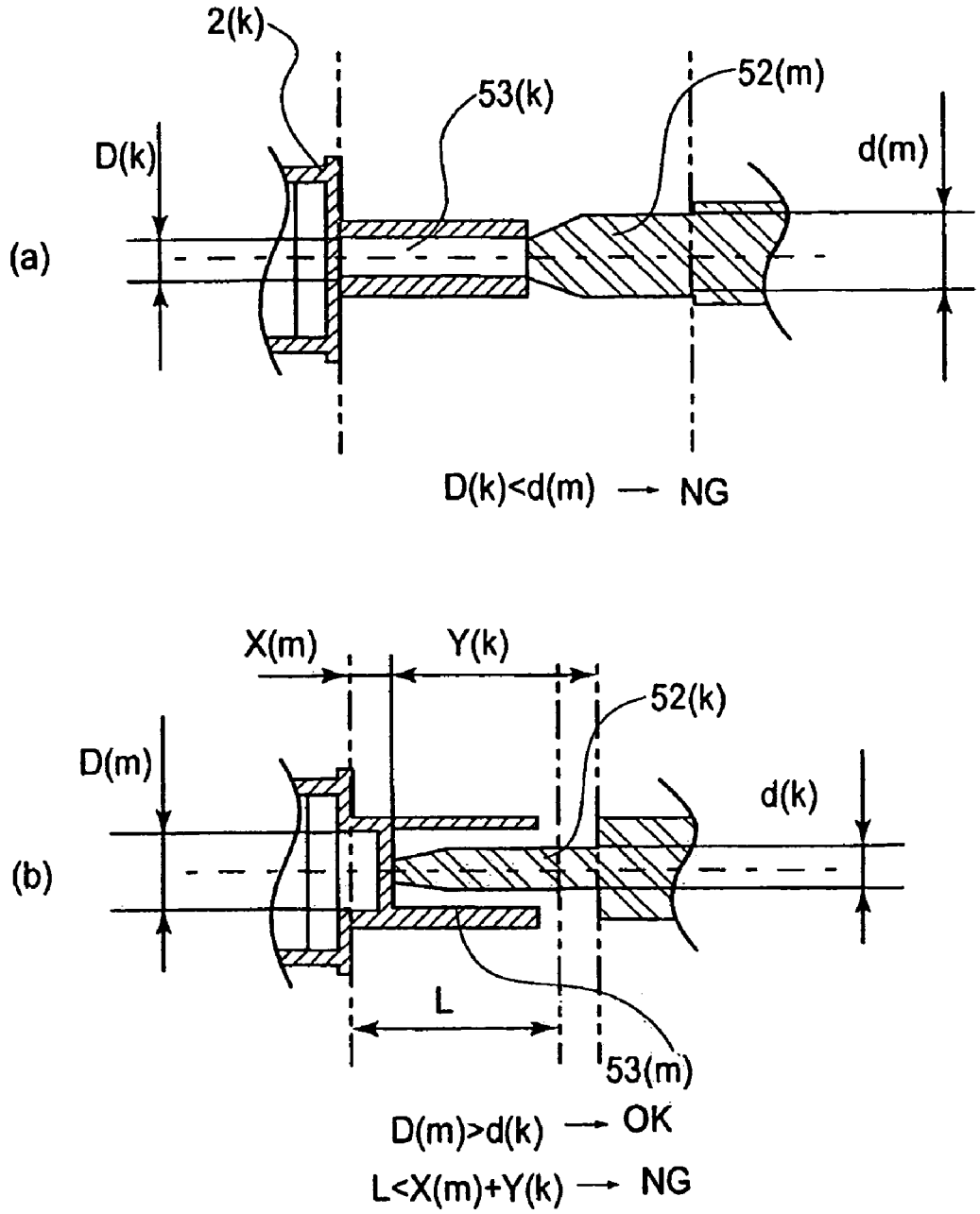
FIGS. 9(A) and 9(B) are partial sectional views for illustrating an example for preventing improper engagement of the driving force transmitting portion with the sealing member.

FIGS. 9(*a*) and 9(*b*) are sectional views showing examples of discrimination in the cases of operation errors.

FIG. 9(*a*) shows the case where a black toner container is accidentally mounted to a toner supply apparatus for magenta. In this case, from the above-described relationships 1 to 3, the following relationship 7 is satisfied.

$$D(k)<d(m) \quad (7)$$

For this reason, the mating portion 52(*m*) cannot be inserted into the engaging portion 53(*k*). Accordingly, the black toner container is not opened in the magenta toner supply apparatus, so that it is possible to prevent mixing of different color toners.

On the other hand, FIG. 9(*b*) shows the case where a magnet toner container is accidentally mounted to a black toner supply apparatus. In this case, from the above described relationships (1) to (3), the following relationship (8) is satisfied.

$$D(m)>d(k) \quad (8)$$

For this reason, the mating portion 52(*k*) can be inserted into the engaging portion 53(*m*).

However, from the above described relationships (4) to (6), the following relationship (9) is satisfied.

$$L<X(m)+Y(k) \quad (9)$$

For this reason, the insertion of the mating portion 52(*k*) into the engaging portion 53(*m*) cannot be completed since the mating portion 52(*k*) runs against the bottom of the engaging portion 53(*m*), thus failing to perform engagement of the sealing member 2 with the drive portion 20. Accordingly, in the black toner supply apparatus, the magenta toner container is not opened, so that it is possible to prevent mixing of different color toners.

As described hereinabove, according to the present invention, by appropriately selecting the reciprocating motions in the rotational axis direction of the toner container and their combinations of the toner container and the release member while ensuring the alignment therebetween on their rotational axes during the engaging operation, engagement, and release of the engagement between the driving force transmitting portion of the image forming apparatus and the sealing member of the toner supply container, it is possible to perform the mounting of the toner supply container in a toner suppliable state, release from the toner supply state, and movement thereof to a container mounting and replacement position. As a result, it is possible to improve performances of mounting and replacement of the toner supply container by the user.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 329611/2004 filed Nov. 12, 2004, which is hereby incorporated by reference.

What is claimed is:

1. A coupling member of a toner supply container detachably mountable to an image forming apparatus, comprising:

a hook portion which is displaceable substantially radially outwardly to establish a hooking engagement with a hole formed in a peripheral portion of a hollow driving member provided in the image forming apparatus by a relative movement between said hook portion and the driving member in a direction so as to cause an overlapping relationship therebetween, to receive a rotational force for discharging a toner in a toner containing portion of the container;

a displacing force receiving portion disposed at a position closer to the toner containing portion than said hook portion with respect to the direction of overlapping, to receive, from a hollow slidable member provided in the image forming apparatus outside the driving member, a displacing force for displacing said hook portion substantially radially inwardly to permit for disengagement a relative movement between said hook portion and the driving member in a direction opposite to the direction of overlapping; and a regulation shaft receiving portion provided with a hollow cylindrical portion in which a regulation shaft disposed in a hollow portion of the driving member is insertable to regulate an inclination of the coupling member relative to the driving member by contact with said regulation shaft when said hook portion is moved away relative to the driving member in a direction opposite to the direction of overlapping in a state in which said displacing force receiving portion receives the displacing force from the slidable member.

2. A coupling member according to claim 1, wherein said coupling member further comprises a sealing portion configured and positioned to seal a toner discharge opening of the container.

3. A coupling member according to claim 2, wherein said hook portion includes an unsealing portion configured and positioned to receive an unsealing force from the driving member in an axial direction of the coupling member.

4. A toner supply container detachably mountable to an image forming apparatus, comprising:

a toner containing portion configured to contain a toner; and a rotatable coupling member engageable with a hollow driving member provided in the image forming apparatus to receive a rotational force for discharging the toner in said toner containing portion;

wherein said coupling member includes:

a hook portion which is displaceable substantially radially outwardly to establish a hooking engagement with a hole formed in a peripheral portion of the driving member by a relative movement between said hook portion and the driving member in a direction so as to cause an overlapping relationship therebetween;

a displacing force receiving portion disposed at a position closer to said toner containing portion than said hook portion with respect to the direction of overlapping, to receive, from a hollow slidable member provided in the image forming apparatus outside the driving member, a displacing force for displacing said hook portion substantially radially inwardly to permit for disengagement a relative movement between said hook portion and the driving member in a direction opposite to the direction of overlapping; and a regulation shaft receiving portion provided with a hollow cylindrical portion in which a regulation shaft disposed in a hollow portion of the driving member is insertable to regulate an inclination of said coupling member relative to the driving member by contact with said regulation shaft when said hook portion is moved away relative to the driving member in a direction opposite to the direction of overlapping in a state in which said displacing force receiving portion receives the displacing force from the slidable member.

5. A toner supply container according to claim 4, wherein said coupling member further comprises a sealing portion configured and positioned to seal a toner discharge opening provided with the toner containing portion.

6. A toner supply container according to claim 5, wherein said hook portion includes an unsealing portion configured and positioned to receive an unsealing force from the driving member in an axial direction of said coupling member.

7. A toner supply system comprising:

a toner supply apparatus including a hollow driving member formed with a hole at a peripheral portion thereof, and a hollow slidable member which is slidable over said driving member, and a regulation shaft; and a toner supply container including a toner containing portion configured to contain a toner and a rotatable coupling member engageable with said driving member to receive a rotational force for discharging the toner in said toner containing portion;

wherein said coupling member includes:

a hook portion which is displaceable substantially radially outwardly to establish a hooking engagement with said hole of said driving member by a relative movement between said hook portion and said driving member in a direction so as to cause an overlapping relationship therebetween;

a displacing force receiving portion disposed at a position closer to said toner containing portion than said hook portion with respect to the direction of overlapping, to receive, from said slidable member, a displacing force for displacing said hook portion substantially radially inwardly to permit for disengagement a relative movement between said hook portion and said driving member in a direction opposite to the direction of overlapping; and a regulation shaft receiving portion provided with a hollow cylindrical portion in which a regulation shaft disposed in a hollow portion of said driving member is insertable to regulate an inclination of said coupling member relative to said driving member by contact with said regulation shaft when said hook portion is moved away relative to said driving member in a direction opposite to the direction of overlapping in a state in which said displacing force receiving portion receives the displacing force from said slidable member.

8. A toner supply system according to claim 7, wherein said hook portion includes an unsealing portion configured and positioned to receive an unsealing force from said driving member in an axial direction of said coupling member.

* * * * *